United States Patent [19]

Ueda et al.

[11] Patent Number: 4,592,705

[45] Date of Patent: Jun. 3, 1986

[54] LUBRICATION FOR ROTARY COMPRESSOR VANE

[75] Inventors: Sei Ueda; Takuho Hirahara; Koji Ishijima; Fumiaki Sano; Kazutomo Asami; Fumio Wada, all of Shizuoka, Japan

[73] Assignee: Mitsubishi Denki Kabushiki Kaisha, Tokyo, Japan

[21] Appl. No.: 705,300

[22] Filed: Feb. 25, 1985

[30] Foreign Application Priority Data

Mar. 6, 1984 [JP] Japan ..... 59-42533

[51] Int. Cl.[4] ..... F04C 18/00; F04C 29/02

[52] U.S. Cl. ..... 418/63; 418/96; 418/248

[58] Field of Search ..... 418/63, 96, 248, 249, 418/65

[56] References Cited

U.S. PATENT DOCUMENTS 2,612,311 9/1952 Warrick et al. ..... 418/63

FOREIGN PATENT DOCUMENTS 832898 3/1952 Fed. Rep. of Germany ..... 418/248

2511443 9/1976 Fed. Rep. of Germany ..... 418/63

*Primary Examiner*—John J. Vrablik

*Attorney, Agent, or Firm*—Sughrue, Mion, Zinn, Macpeak and Seas

[57] ABSTRACT

The vane slot 20 and lubricating oil passageway 21 in the cylinder member 3 of a rotary vane compressor are configured such that the radial length of the slot wall 20*a* on the low pressure side of the vane 5 is less than that of the opposite wall 20*b* on the high pressure side. Such a shortened low pressure side slot wall reduces wear by providing improved lubrication at the critical inward edge of the slot (F1), and facilitates the flushing away of abrasive particles formed during the initial seating of the vane. For a horizontal installation the lubricating oil level is maintained below the radially outermost edge of the wall 20*a* to prevent the oil from being drawn into the low pressure chamber 17 when the compressor is stopped.

6 Claims, 6 Drawing Figures

FIG. 2
PRIOR ART
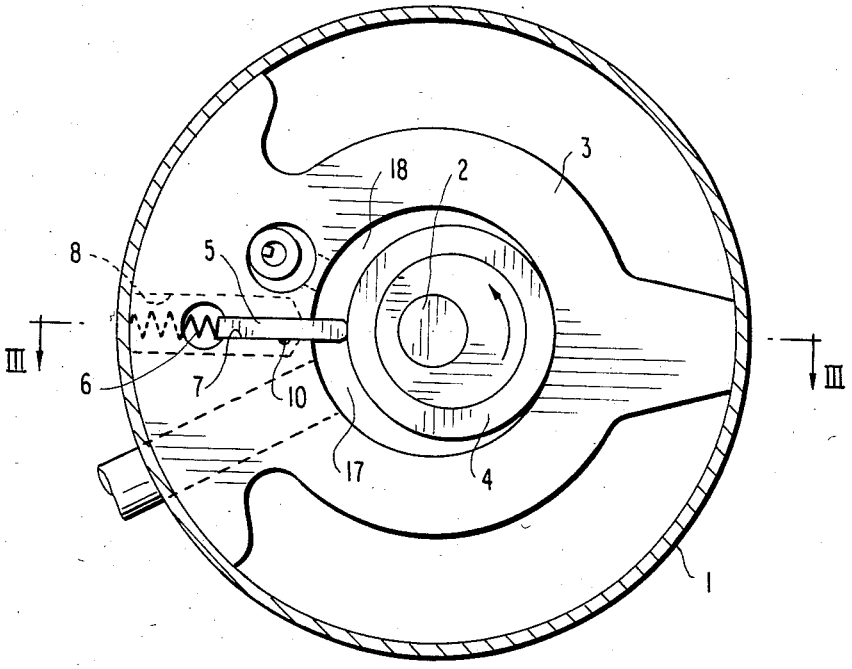
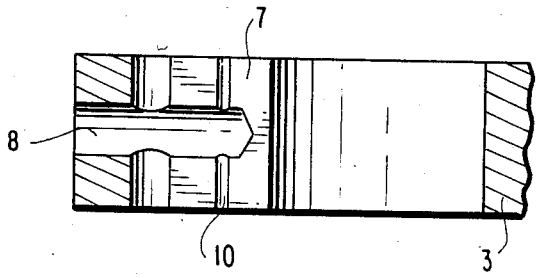
FIG. 3
PRIOR ART

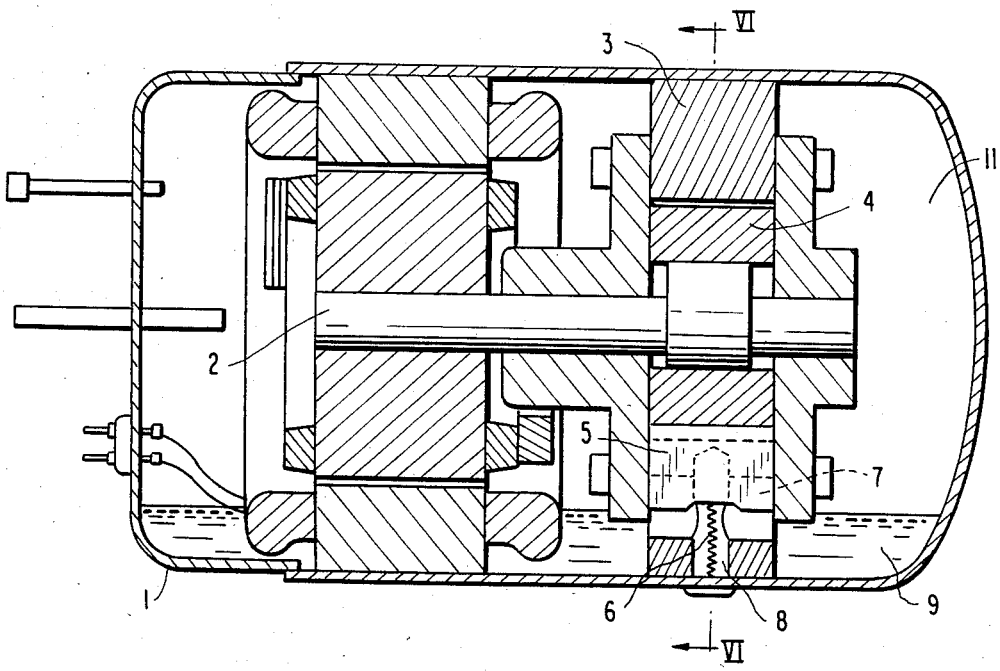
FIG. 5
FIG. 4
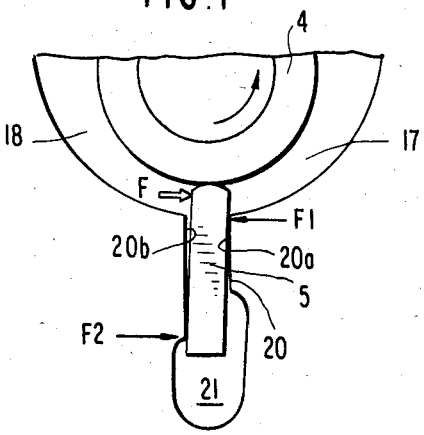
FIG. 6
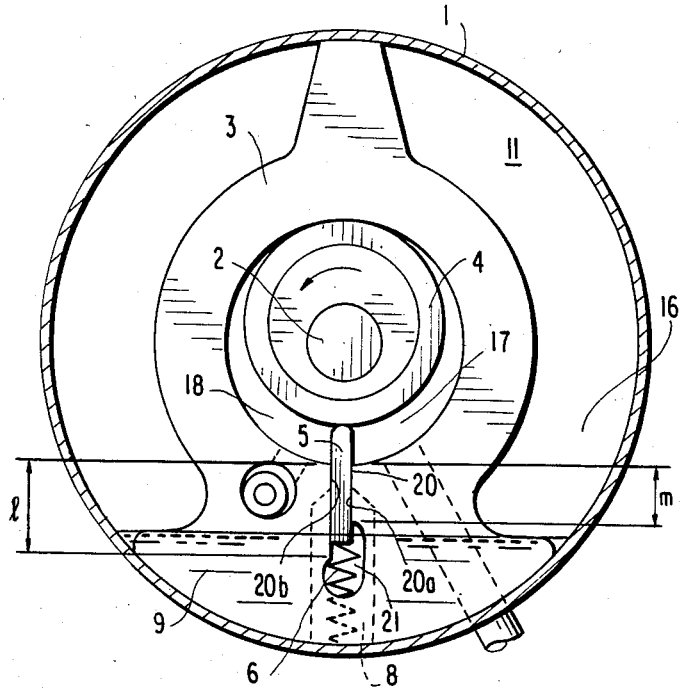

LUBRICATION FOR ROTARY COMPRESSOR VANE

BACKGROUND OF THE INVENTION

This invention relates to a rotary vane compressor for refrigerant fluids, and particularly to a configuration of the cylinder slot which accommodates the sliding or reciprocating vane for implementing improved lubrication, reduced wear and lubricant leakage, and the more expeditious flushing of abrasive wear particles.

A vertically installed refrigerant compressor of this general type and as described in Japanese patent application Ser. No. 57-165903 published May 12, 1984 is shown in FIGS. 1-3, and will only be briefly described as its overall construction and operation are well known and conventional. Essentially, a cylinder member 3 is clamped or bolted between a pair of opposing end plates within a sealed outer casing or shell 1. An eccentrically mounted cylindrical piston 4 is rotatably driven within the cylinder member by an electric motor via a crankshaft 2, and a blade-like vane 5 slidably mounted within a slot 7 in the cylinder member and biased inwardly by a spring 6 disposed within an aperture 8 bears against the surface of the piston and is reciprocatingly driven thereby during the rotation of the piston. The vane defines and separates high and low pressure chambers 18, 17 between the piston and the cylinder member. Refrigerant fluid drawn in on the low pressure side of the vane (just below the vane in FIG. 2) from an accumulator is compressed and discharged into the space 11 within the shell surrounding the motor and cylinder member, and a compressed fluid outlet pipe is provided at the top of the shell. The interior of the shell is thus maintained at a high pressure level, which is utilized to force lubricating oil 9 in a sump area at the bottom of the shell into the vane slot 7 to thus lubricate the sliding vane.

Frictionally induced wear and abrasion between the sliding vane 5 and its accommodating slot 7 within the cylinder member has long been a serious problem in compressors of this type. Such wear is enhanced by the differential pressure to which the vane is subjected between the high and low pressure chambers, which tends to push the inner tip of the vane downwardly as seen in FIG. 2, and by the frictional drag of the piston 4 as it rotates, which tends to draw the vane tip with it in the same direction. One result of such wear is the leakage of lubricating oil into the low pressure chamber along the lower wall of the slot 7 as viewed in FIG. 2 when the compressor is stopped, which is assisted by the partial vacuum drawn in such chamber. The presence of lubricating oil within the cylinder member 3 causes premature wear of the crankshaft bearings owing to the incompressibility of liquids, and such bearing failure sharply curtails the useful working life of the compressor.

One approach to reduce the problem of vane slot wear was to machine or otherwise form a lateral groove 10 in the wall of the slot 7 on the low pressure side of the vane, such slot assisting in the more uniform distribution of lubricating oil supplied to the slot via the spring aperture 8 and also enhancing the flushing away of abrasive metal particles attendant to the wearing of the slot— particularly during the initial use of the compressor as the reciprocating vane establishes its seat in the slot. While such a groove represents a useful expedient, it is relatively costly to implement owing to the tight and restricted accessibility to its location, which considerably complicates the forming of the cylinder member 3 by conventional and less expensive sintering methods.

SUMMARY OF THE INVENTION

In accordance with this invention the slot wear and lubrication problems attendant with the earlier constructions are substantially avoided by forming the cylinder member of a rotary vane compressor using conventional sintering techniques, such that the length of the slot wall of the low pressure side of the reciprocating vane, in the direction of the movement of the vane, is less than the length of the slot wall on the opposite, high pressure side of the vane.

BRIEF DESCRIPTION OF THE DRAWINGS

FIG. 2 is a cross-section of the compressor taken on line II—II of FIG. 1, FIG. 3 is a cross-section of the compressor taken on line III—III of FIG. 2, FIG. 4 is a simplified and dimensionally exaggerated cross-section through the vane and slot portion of a compressor constructed in accordance with the present invention, for explaining the rationale and operation thereof, FIG. 5 is a vertical section of a horizontally oriented rotary vane compressor in accordance with the invention, and FIG. 6 is a cross-section taken on line VI—VI of FIG. 5.

DETAILED DESCRIPTION OF THE PREFERRED EMBODIMENTS

Figure 1:
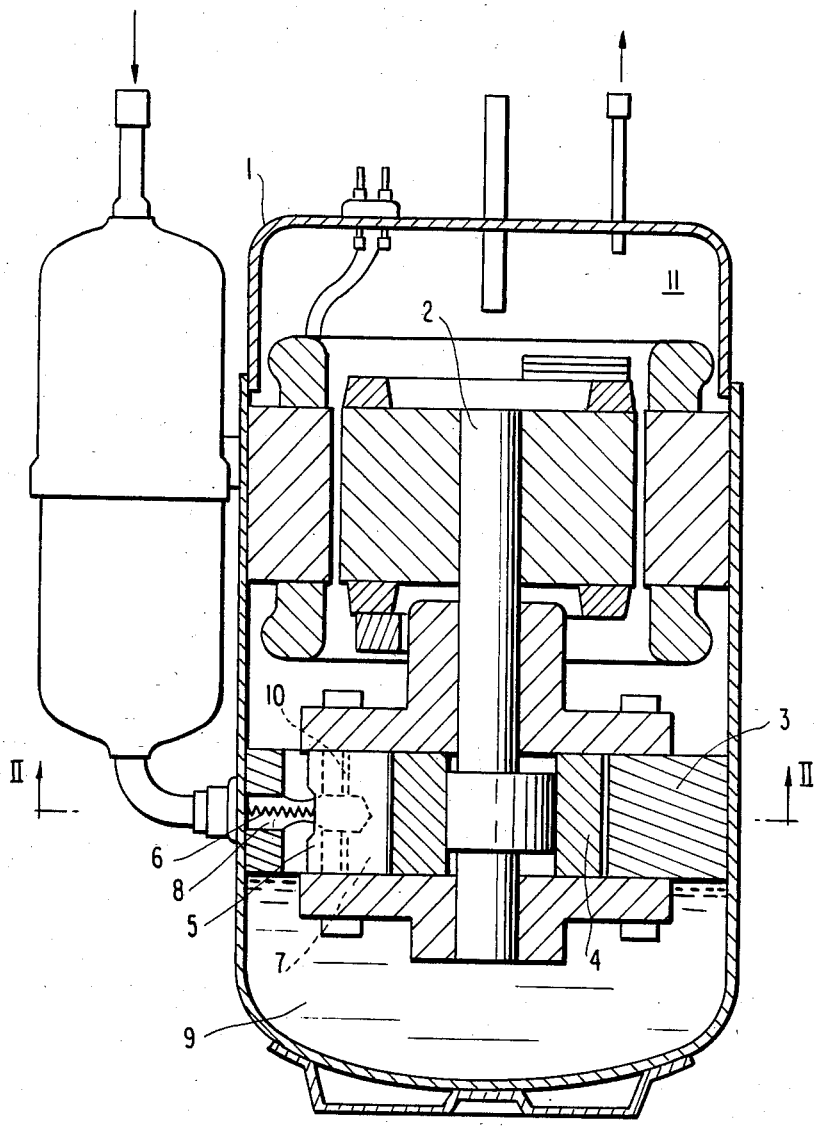
FIG. 1 PRIOR ART
FIG. 1 is a vertical section through a conventional, vertically oriented rotary vane compressor.

Referring to the exaggerated schematic presentation of FIG. 4 for purposes of explanation, the combined effects of the differential pressure between the low and high pressure chambers 17, 18 within the cylinder member 3 and the frictional drag of the rotating piston 4 on the tip of the vane 5 generate a force F on the exposed portion of the vane within the cylinder member which tends to rotate the vane clockwise within its slot 20, and such force is countered by oppositing forces F1 and F2 applied against the vane by the low pressure and high pressure sides of the slot walls **20*a*, 20*b* at opposite ends of the slot. The points of application of the forces F1 and F2 are thus the critical wear points or edges of the vane slot where the great majority of the friction and abrasion takes place; the point of application of the force F2 at the most radially outward edge of the high pressure wall 20*b* of the slot is of less concern as the high pressure within chamber 18 prevents the entry of lubricating oil and abrasion particles through the gap (greatly exaggerated) between the vane 5 and the wall 20*b***.

In accordance with this invention the vane slot 20 in the cylinder member and the passageway 21 at the radially outermost end of the slot which extends parallel to the compressor axis and serves to distribute the lubricating oil are formed, using conventional and comparatively inexpensive sintering techniques, such that the wall **20*a* of the slot on the low pressure side of the vane is substantially shorter than the slot wall 20*b* on the opposite, high pressure side. This is achieved by, in effect, extending the oil passageway 21** radially inwardly on the low pressure side of the vane in an asymmetrical manner, as contrasted with the fully symmetrical configuration of such passagway in the earlier constructions.

Although the manner in which such a shortened vane slot wall on the low pressure side serves to reduce frictional wear, to improve the lubrication of the vane and thus reduce the sliding friction at the slot opening into the cylinder member at the low pressure side of the vane, and to expedite the flushing away of abrasive metallic particles produced during the initial seating of the vane is not fully understood, it is most likely that such improvements result from the attendantly shortened length of the slot gap between the vane and the wall 20*a* through which the lubricating oil must travel to reach the critical wear edge whereat the reaction force F1 is applied and through which the abrasive particles must also travel in order to be flushed away with the lubricating oil through the passageway 21. It is also noted that the shortening of the radial length of the slot wall 20*a* has no detrimental effects in terms of reducing the bearing surface area since, as exaggeratedly illustrated in FIG. 4, there is substantially no sliding contact between the vane and the radially outermost portion of the wall 20*a* during the operation of the compressor due to the tendency of the applied force F to rotate the vane.

Turning now to a more specific or practical application of the invention as shown in FIGS. 5 and 6, illustrated by way of example in connection with a horizontally oriented refrigerant fluid compressor, those components and features designated by the same reference numerals shown in FIGS. 1–3 will not be described in detail as their structure and function are identical. As best seen in the cross-sectional view of FIG. 6, the vane slot 20 and the lubricant passageway 21 are formed such that the length m of the slot wall 20*a* on the low pressure side of the vane 5 is substantially less than the length 1 of the slot wall 20*b* on the high pressure side to thus achieve all of the benefits and improvements described above in connection with FIG. 4. Moreover, the upper level of the lubricant oil 9 is preferably established and maintained at a point below the radially outermost edge of the shortened vane slot wall 20*a*. Such a lubricant level prevents the oil 9 from being drawn into the low pressure chamber 17 by the partial vacuum pevailing therein when the compressor is stopped; with the oil level above the outer edge of the slot wall 20*a* the high pressure in the space 11 within the shell would assist in forcing the oil up through the gap between the vane and the wall 20*a* and into the cylinder member chamber 17. Such an oil level does not in any way detract from or interfere with the proper lubrication of the vane as it is constantly plunged into and out of the oil bath during operation, and draws the proper amount of oil within it by surface tension adherence and as a result of splashing.

Although the invention has been specifically disclosed in connection with a horizontally oriented compressor, its teachings and advantages are equally applicable to a vertically oriented compressor as will be obvious to those skilled in the art.

What is claimed is:

1. A rotary vane compressor including a cylinder member (3), an eccentrically driven circular piston (4) rotatably disposed within the cylinder member, a radial slot (20) formed in the cylinder member, a blade-like vane (5) slidably disposed within the slot, spring means (6) biasing the vane radially inwardly such that a tip thereof abuts the piston and attendantly separates the cylinder member into low pressure and high pressure, variable volume chambers (17, 18), and a lubricant oil passageway (21) formed in the cylinder member and communicating with a radially outermost end of the slot, characterized by:

the radial length m of a wall (20*a*) of the slot of a low pressure side of the vane, as measured from an innermost point lying at a radius r from a center of the cylinder member to an outermost point, being shorter than the radial length l of an opposite wall (20*b*) of the slot on a high pressure side of the vane, as measured from an innermost point also lying at a same radius r from the center of the cylinder member to an outermost point, to enhance lubrication, attendantly reduce wear, and facilitate the flushing away of abrasive particles.

2. A compressor according to claim 1, wherein a portion of the oil passageway on the low pressure side of the vane is extended radially inwardly to attendantly shorten the radial length of the adjacent slot wall.

3. A compressor according to claim 1, wherein the compressor is horizontally oriented, is enclosed within a sealed pressure shell, the vane and slot are disposed at a radially lowermost portion of the cylinder member, and a supply of lubricant oil (9) is contained within the shell such that an upper level thereof lies below a radially outermost and thus lowermost edge of the shorter slot wall.

4. A rotary vane compressor including a cylinder member (3), an eccentrically driven circular piston (4) rotatably disposed within the cylinder member, a radial slot (20) formed in the cylinder member, a blade-like vane (5) slidably disposed within the slot, spring means (6) biasing the vane radially inwardly such that a tip thereof abuts the piston and attendantly separates the cylinder member into low pressure and high pressure, variable volume chambers (17, 18), and a lubricant oil passageway (21) formed in the cylinder member and communicating with a radially outermost end of the slot, characterized by:

the radial length m of a wall (20*a*) of the slot on a low pressure side of the vane being shorter than the radial length l of an opposite wall (20*b*) of the slot on a high pressure side of the vane, wherein a portion of the oil passageway on the low pressure side of the vane is extended radially inwardly to attendantly shorten the radial length of the adjacent slot wall.

5. A compressor according to claim 4, wherein the compressor is horizontally oriented, is enclosed within a sealed pressure shell, the vane and slot are disposed at a radially lowermost portion of the cylinder member, and a supply of lubricant oil (9) is contained within the shell such that an upper level thereof lies below a radially outermost and thus lowermost edge of the shorter slot wall.

6. A rotary vane compressor including a cylinder member (3), an eccentrically driven circular piston (4) rotatably disposed within the cylinder member, a radial slot (20) formed in the cylinder member, a blade-like vane (5) slidably disposed within the slot, spring means (6) biasing the vane radially inwardly such that a tip thereof abuts the piston and attendantly separates the cylinder member into low pressure and high pressure, variable volume chambers (17, 18), and a lubricant oil passage (21) formed in the cylinder member and communicating with a radially outermost end of the slot, characterized by:

the radial length m of a wall (20*a*) of the slot on a low pressure side of the vane being shorter than the radial length l of an opposite wall (20*b*) of the slot on a high pressure side of the vane, wherein the compressor is horizontally oriented, is enclosed within a sealed pressure shell, the vane and slot are disposed at a radially lowermost portion of the cylinder member, and a supply of lubricant oil (9) is contained within the shell such that an upper level thereof lies below a radially outermost and thus lowermost edge of the shorter slot wall.

* * * * *